US011193395B2

(12) United States Patent
Giraud et al.

(10) Patent No.: US 11,193,395 B2
(45) Date of Patent: Dec. 7, 2021

(54) METHOD AND FACILITY FOR RECOVERING THERMAL ENERGY ON A FURNACE WITH TUBULAR SIDE MEMBERS AND FOR CONVERTING SAME INTO ELECTRICITY BY MEANS OF A TURBINE PRODUCING THE ELECTRICITY BY IMPLEMENTING A RANKINE CYCLE

(71) Applicant: FIVES STEIN, Maisons Alfort (FR)

(72) Inventors: Patrick Giraud, Maisonns-Alfort (FR); Aurélie Gonzalez, Paris (FR)

(73) Assignee: FIVES STEIN, Maisons Alfort (FR)

( * ) Notice: Subject to any disclaimer, the term of this patent is extended or adjusted under 35 U.S.C. 154(b) by 309 days.

(21) Appl. No.: 16/313,610

(22) PCT Filed: Jun. 26, 2017

(86) PCT No.: PCT/EP2017/065646

§ 371 (c)(1),
(2) Date: Dec. 27, 2018

(87) PCT Pub. No.: WO2018/001931

PCT Pub. Date: Jan. 4, 2018

(65) Prior Publication Data

US 2019/0226364 A1 Jul. 25, 2019

(30) Foreign Application Priority Data

Jun. 27, 2016 (FR) ..... 1655976

(51) Int. Cl.
*F01K 23/10* (2006.01)
*F27D 17/00* (2006.01)
(Continued)

(52) U.S. Cl.
CPC ..... *F01K 23/10* (2013.01); *F01K 25/08* (2013.01); *F27B 9/10* (2013.01); *F27B 9/30* (2013.01);
(Continued)

(58) Field of Classification Search
CPC ..... F01K 23/16; F01K 23/18; F01K 25/04; F01K 25/08; F27D 2017/004; F27D 2017/006; F27B 9/10; F27B 9/30
See application file for complete search history.

(56) References Cited

U.S. PATENT DOCUMENTS

2004/0259047 A1 12/2004 Le Goueffec et al.
2012/0000201 A1* 1/2012 Ast ..... F01K 23/10 60/652
2012/0279213 A1* 11/2012 Conard ..... F01K 9/003 60/517

FOREIGN PATENT DOCUMENTS

EP 0971192 A 1/2001
GN 102644488 B 12/2014
(Continued)

OTHER PUBLICATIONS

International Search Report, dated Aug. 23, 2017, from corresponding PCT/EP2017/065646 application.

*Primary Examiner* — Steven S Anderson, II
(74) *Attorney, Agent, or Firm* — Nixon & Vanderhye

(57) ABSTRACT

A heat energy recovery installation installed on a beam reheating furnace equipped with burners includes a turbine that generates electricity by implementing a Rankine cycle on an organic fluid coming from calories derived partly from the fluid used for cooling the tubular beams via a first intermediate circuit, and in part from flue gases from the burners by way of a second intermediate circuit.

15 Claims, 4 Drawing Sheets

(51) Int. Cl.
*F01K 25/08* (2006.01)
*F27B 9/10* (2006.01)
*F27B 9/30* (2006.01)

(52) U.S. Cl.
CPC ..... *F27D 17/004* (2013.01); *F27D 2017/006* (2013.01)

(56) References Cited

FOREIGN PATENT DOCUMENTS

| | | | | |
|---|---|---|---|---|
| JP | 56065918 | A | * | 6/1981 |
| KR | 20140036363 | A | * | 3/2014 |
| KR | 20140036363 | A | | 3/2014 |
| WO | 03021174 | A1 | | 3/2003 |
| WO | 2014/195882 | A2 | | 12/2014 |

* cited by examiner

METHOD AND FACILITY FOR RECOVERING THERMAL ENERGY ON A FURNACE WITH TUBULAR SIDE MEMBERS AND FOR CONVERTING SAME INTO ELECTRICITY BY MEANS OF A TURBINE PRODUCING THE ELECTRICITY BY IMPLEMENTING A RANKINE CYCLE

BACKGROUND OF THE INVENTION

FIELD OF THE INVENTION

The invention relates to the field of recovering heat energy coming from beam furnaces and its conversion into electricity by means of an expansion cycle turbine using a fluid other than water vapour.

The invention relates in particular to beam reheating furnaces intended to heat products, especially slabs, blooms, blanks or billets, operating at a suitable temperature for their hot rolling, and particularly for walking beam furnaces. A reheating furnace makes it possible to heat the products at high temperatures, for example at a temperature of about 1200° C. for carbon steel. Heating the furnace is commonly carried out using burners fed with preheated air and fuel and operating with slightly excess air.

DESCRIPTION OF THE RELATED ART

EP0971192 describes an example of a beam-furnace equipped with fixed beams, and walking beams. The products are deposited on beams and heated by burners arranged both above and below the products. The beams consist of cooled skids and posts. The walking beams enable the transport of products in the furnace following a cycle comprising a first climb phase by the walking beams, from an initial position, which makes it possible to lift the products. The first phase is followed by a second phase of horizontal transport by the walking beams and a third phase of removal of the products on the fixed beams. The products are thus moved one step on the fixed beams before the fourth phase of kick-back of the walking beams in their initial position. The skids of the fixed beams are borne by posts integral with the hearth of the furnace. The skids of the walking beams are borne by posts passing through the hearth of the furnace and fixed, under the furnace, on a translation chassis. The translation chassis is supported by a mechanism that ensures a rectangular cycle by the horizontal and vertical movement of the chassis assembly, posts and skids of the walking beams.

The structure of the beams is made up of tubes or hollow profiles which are cooled by circulating heat transfer fluid, which is traditionally water at low temperature and low pressure, for example 30° C. to 55° C. and 5 bar. The quantity of energy discharged per unit of time by the heat transfer fluid is important in order to limit the temperature and to have sufficient mechanical strength of the structure of the beams. The power discharged is for example 10 $MW_{th}$ for a furnace with a capacity of 450 t/h. The hot water recovered at the outlet of the beams can then be used in the plant, for example for sanitary purposes, the heating of buildings, or processes for which relatively low temperatures are required. It is known that the low-temperature and low-pressure water cooling the beams can be replaced with superheated water at high pressure, which partially transforms into saturated steam in the skids. The resulting steam can be used in the plant for different needs. The cooling of the structure of the beams by a mixture of saturated water and steam is advantageous, particularly because this makes it possible to ensure the operation of the structure of the beams at a stable temperature. Indeed, since the phase transition from the liquid phase to the vapour phase takes place at a substantially constant temperature, the outlet temperature of the beam coolants is constant, regardless of the operating regime of the furnace, only the amount of water changing into the vapour phase changes. The outlet temperature of the cooling fluid is, for example, 215° C. for a fluid pressure of 21 bars absolute.

A heat recuperation equipment is traditionally arranged in a flue pipe from the furnace. It enables energy recovery on these fumes by preheating the combustion air of the burners and sometimes the fuel. Downstream of this heat recuperation equipment, the flue gas temperature remains relatively high, for example 300° C. Adding other heat exchangers, or a recovery boiler, into flues to further exhaust the fumes is known. Where the cooling of the structure of the beams is achieved by superheated water with steam production, it may for example be a superheated water saver or a superheater steam.

Steel reheating furnaces operate continuously and have large production capacities, for example 450 t/h. Their operating regime varies frequently, particularly according to the nature and temperature of the products put in the furnace and the timing of the furnace. As a result, the volume of exhaust gases also varies frequently, since it is substantially proportional to the hourly tonnage of the products heated in the furnace. The changes in the flue gas flow are also accompanied by a temperature variation of said fumes. These fluctuations on the temperature of the fumes lead to a significant variation in the efficiency of the exchangers arranged in flues or recovery boilers. At reduced tonnage, the flue gas temperature no longer makes it possible to recover the residual energy of the steam.

The products to be heated in the furnace must always be heated to the rolling temperature, and this being relatively constant, the temperature of the furnace walls varies slightly. Since the thermal losses via the beams fluctuate slightly, the generation of steam by a cooling system of the beam structure is less dependent on the hourly tonnage of the furnace.

The thermal energies contained in the fumes and the beam coolants each represent about 10 $MW_{th}$ on a furnace of 450 t/h with temperatures respectively of around 300° C. and 200° C. The use of a water-steam cycle to generate electricity from these energies is difficult to implement and is not economically profitable with these levels of temperature and thermal power, as well as these amplitudes of power variations.

KR20140036363 describes a solution for energy recovery on a steel reheating furnace that makes it possible to evaluate the energy losses of the furnace contained in the fumes and in the cooling system of the beams, by exploiting them in a common electricity generation facility, while avoiding the problems of variability thereof. It implements an electricity generation by a Rankine thermodynamic cycle using an organic fluid as working fluid. An Organic Rankine Cycle (ORC) machine enables the conversion of medium and low temperature heat into electricity through the use of an organic working fluid density that is higher than that of water. In the ORC machine, the working fluid in liquid state is compressed and vaporized. The organic fluid vapour is then expanded before being condensed. The machine particularly comprises an evaporator, an expansion turbine, a condenser and a booster pump. The expansion turbine is for example of radial or axial type, with one or two stages, the rotation of which drives an alternator which generates electricity.

The organic fluid has a low boiling point, for example less than 50° C. at atmospheric pressure, and is of the wetting type, that is to say that it is not necessary to overheat the vapour of this fluid after evaporation to avoid creating droplets in the turbine during expansion. In spite of a low temperature of the hot reservoir, this type of fluid can thus make it possible to extract maximum work in the turbine and thus have a better efficiency than a steam cycle at low temperatures, for example below 350° C.

Thus, the choice of the ORC technology, among the various thermodynamic cycles for generating electricity, provides a better thermodynamic machine efficiency, that is to say the ratio of available thermal energy to net electricity generated.

The calories needed to vaporize the organic fluid of the ORC machine are provided by the energy recovered on the heating furnace, partly on the beam coolants and partly on the combustion fumes.

In the solution disclosed by KR20140036363, the cooling fluid of skids and posts is a mixture of molten salts. This mixture is for example composed, by mass, of 52% of $KNO_3$, 18% of $NaNO_3$ and 30% of $LiNO_3$. To maintain these molten salts within the temperature range required for proper operation of the furnace, and especially for maintaining them in the liquid phase, the installation comprises a recirculation loop 40 with additional equipment which makes the more expensive and relatively complex to exploit with respect to a solution in which the cooling fluid is water or a water/steam mixture. Calories from the molten salts are transmitted to the organic fluid of the ORC by means of an exchanger 21. In the event of deterioration of this exchanger, the molten salts can come into contact with the organic fluid of the ORC, which constitutes a risk for the installation. In addition, this solution does not make it possible to modulate the heat input of the molten salts to the organic fluid of the ORC. If the ORC stops, the continuous intake of calories by the molten salts can lead to a very significant rise in the temperature of the organic fluid, hence a risk for the installation.

Moreover, KR20140036363 describes a solution in which part of the fumes exchanges heat directly with the organic fluid of the ORC by means of a heat exchanger 51. In the event of deterioration of this exchanger, there is a risk of fire if the organic fluid of the ORC comes in contact with the fumes.

The state of the art does not allow a double energy recovery on the fumes of the heating furnace and on the cooling fluid of skids and posts under conditions allowing optimal energy efficiency, flexibility in regulating the ORC operation and safe operating conditions.

BRIEF SUMMARY OF THE INVENTION

According to a first aspect of the invention, this object is achieved with a method of energy recovery by an energy recovery installation, adapted to be connected to at least one beam reheating furnace equipped with burners, said beam reheating furnace comprising a cooling system of said beams, in which water circulates, this being in liquid state at the inlet of the beams and in the liquid/vapour mixing state at the outlet of the beams, said mixture being separated downstream of the beams into liquid water on one side and steam on the other, the steam directly or indirectly transferring calories to a first intermediate recirculation loop, and furthermore a recovery system of energy to absorb a portion of the calories of the flue gas exhausted by the furnace, said calories being transferred to a second intermediate recirculation loop, said first and second intermediate recirculation loops directly or indirectly transferring calories to an organic fluid loop arranged to feed a turbine that generates electricity by implementing an organic Rankine cycle.

In a configuration in which the cooling of the skids is performed by water and a water/steam mixture, the condensation of the vapours in the exchanger allows a significant transfer of calories between the vapour and the organic fluid of the ORC.

According to the invention, the calories coming from the steam and those coming from the flue gas circuit are indirectly transferred to the organic fluid of the ORC, via a first intermediate recirculation loop arranged between a circuit comprising the vapour and the organic fluid, respectively via a second intermediate recirculation loop disposed between the flue gas circuit and the organic fluid.

The steam circuit is isolated from the organic fluid by at least two devices, such as two exchangers.

The flue gas circuit is isolated from the organic fluid by at least two devices, such as two exchangers.

Thus, according to the invention, the calories from the steam are first transferred to a first intermediate recirculation loop before being transferred to the organic fluid used in the Rankine cycle. Also, although vapour has a very high pressure compared to that of the organic fluid, there is no significant risk of explosion if the exchanger breaks through, even if the organic fluid of the ORC is very often a hydrocarbon or an inflammable refrigerant, because the vapour cannot come into contact with said organic fluid.

Furthermore, according to the invention, the calories from the fumes are first transferred to a second intermediate recirculation loop before being transferred to the organic fluid used in the Rankine cycle. There is also no possible exchange between the organic fluid used in the Rankine cycle and the flue gases, which avoids a risk of fire that is present in the prior art.

According to the invention, the method thus has more security than that of the prior art.

The combination of the two energy sources coming from the flue gases and the cooling system makes it possible on the one hand to be able to increase the annual total electricity generation and on the other hand to be able to limit the investment. Indeed, this combination makes it possible to obtain a greater quantity of usable energy in a single ORC machine of great capacity (cheaper and with a better performance), than if the two heat sources were exploited separately by two ORC machines of smaller capacity (lower performance and proportionately more expensive).

In addition, the combination of the two energy sources coming from the flue gases and the cooling system can stabilize the energy input supplied to the ORC machine. The combination of the two energy sources coming from the flue gases and the cooling system can make the ORC machine work more often at its optimum operating range.

The dimensioning of the ORC machine makes it possible to limit the amount of investment, and therefore the time required for the return on investment, thus increasing the economic beneficial interest of its implementation. In its design, the size of a reheating furnace is made for a nominal production capacity that corresponds to heating a number of tons per hour of a reference product from an initial temperature to a boiling point. By experience, during operation, the furnace operates on average about 70% of its nominal capacity.

Moreover, an ORC machine operates correctly over a wide range of variations of the heat source, the incoming thermal power can generally vary between 30% and 100%. The maximum efficiency of the ORC machine is obtained for the maximum design power and it decreases with the input thermal power. An ORC machine must be stopped when the supply of calories to the organic fluid of the ORC machine is below a minimum threshold generally between 20% and 30% of the maximum capacity allowed by the ORC machine. By combining the two sources of thermal energy, the invention ensures that the supply of calories is never less than 30% of the thermal load, thanks to the stability and the capacity of the heat source coming from the cooling system of the beams. Thus, the ORC machine is always in operation, except in the case of installation shut down, and does not require complex control.

According to another aspect of the invention, there is provision for an energy recovery installation which can be connected to at least one beam reheating furnace equipped with burners, said beam reheating furnace comprising a cooling system of said beams, in which water circulates, the latter being in the liquid state at the inlet of the beams and in the liquid/vapour mixture state at the outlet of the beams, said mixture being separated downstream of the beams in liquid water on one side and steam on the other, said installation comprising a turbine arranged to generate electricity by implementing a Rankine cycle on an organic fluid, said installation further comprising at least heat exchangers functionally arranged so as to transfer to said organic fluid, at least a portion of the calories contained in flue gases of the burners, via a heat transfer fluid, and at least part of the calories contained in the vapour, via a heat transfer fluid.

According to one possibility of the installation, at least one beam reheating furnace may comprise a heat exchanger which is arranged in a flue gas discharge of said at least one beam reheating furnace to collect calories from said flue gases and transmit them to the heat transfer fluid circulating in said heat exchanger.

Placed in the flue gas discharge, according to the invention, the exchanger may optionally be disposed downstream in the direction of the flue gas flow of other pieces of energy recovery equipment on the flue gases. The other pieces of energy recovery equipment may be, for example, a recuperator for preheating the combustion air of the burners.

According to one of the aspects of the invention, the installation comprises a first heat exchanger functionally arranged so as to directly or indirectly transfer the energy of the vapour to an intermediate heat transfer fluid, and a second heat exchanger disposed in order to transfer heat energy from said intermediate heat transfer fluid to the organic fluid of the ORC machine.

According to the invention, the intermediate heat transfer fluid may be an organic fluid in liquid state, under the conditions of use, for example a thermal oil. Advantageously, the heat-transfer medium fluid is non-inflammable at the temperature at which it is used, its ignition temperature being substantially greater than that of the organic fluid of the ORC.

This configuration makes it possible to improve the robustness of the equipment by limiting the sudden variations in exchange temperatures with the organic fluid of the ORC in case of shut down of the furnace thanks to the energy storage capacity of the mass intermediate fluid. It also helps to improve the safety of the heat coming from the steam of the exchange system with the exchanger by locally controlling the behaviour of this exchange without disturbing the loop supplying the ORC exchanger. As the steam is at a substantially higher pressure than that of the intermediate fluid (approximately 20 bar on the steam side against approximately 4 to 7 bars on the intermediate fluid side), in case the exchanger is break through, the fluid flow would be from the steam circuit towards the intermediate fluid circuit thus avoiding the spread of the intermediate fluid into the skids and posts.

Moreover, the presence of an intermediate circuit between the steam circuit and the ORC circuit makes it possible to prevent the steam from coming into contact with the organic fluid of the ORC, said contact being able to be a source of explosion.

This solution also allows the use of a robust technology exchanger for the exchange between the intermediate fluid and the organic fluid of the ORC, the two fluids having similar properties. It thus helps to reinforce the operational safety of the ORC machine in the event of a problem on the steam cooling circuit of the beams.

To further enhance the safety of the installation, an additional intermediate loop can be added between the steam and the intermediate fluid described above.

Using an intermediate organic fluid to recover calories from flue gases which fluid remains in liquid state, regardless of the temperature and volume fluctuations of the flue gases in the fume discharge pipe, has the advantage of greatly facilitating operation of the installation with respect to the implementation of a recovery boiler in which a phase transition in the exchanger takes place at higher pressure.

Advantageously according to the invention, regulating the supply of calories to the ORC machine can be carried out on the flue gas circuit, by means of a partial bypass of the flue gases exhaustion exchanger placed in the flue pipe or a dilution of the flue gases with cold air to lower the temperature. Due to the dimensioning of the ORC for an operation of the furnace at 70% of its nominal capacity, if the heat input to the ORC machine becomes too high, part of the flue gases bypasses the exchanger of the flue gases exhaustion circuit or the flue gases will be diluted without interfering with the furnace operation.

The heat transfer fluid used to collect calories from combustion flue gases and the one used indirectly to collect calories from skids and posts can be of the same nature, but this method also allows the use of heat transfer fluids of different properties. This can optimize the recovery of energy with fluids used at different temperature levels and enhance the safety of the installation by choosing fluids that minimize the risk of fire or explosion in case of contact between fume or steam and these fluids.

As an alternative embodiment, the addition of energy storage on the intermediate circuits makes it possible to improve the efficiency of the assembly without disturbing the main exchange circuit towards the ORC.

Advantageously, the operation of the cooling system of the beams may not be modified by the presence of the ORC machine. The control of the installation can thus be simplified.

The heat output transmitted to a thermal fluid used in the flue gas exhaustion circuit can be determined directly by the temperature rise of said fluid in a heat exchanger of the flue gases exhaustion system.

If the ORC machine stops, a flue gases bypass placed on the flue gas circuit can prevent heating of the thermal fluid used in the flue gas exhaustion circuit. Another method is to use a heat transfer fluid operating at higher temperature on the intermediate loop and/or to reduce the flue gas temperature while diluting them, for example, with inlet air upstream of the recuperation equipment placed on the flue pipe. Cooling towers can also be placed on the superheated water/steam circuit so as to evacuate calories from the beams.

Advantageously according to the invention, the ORC machine is dimensioned according to the average operating regime of the reheating furnace and not according to the nominal capacity of the furnace. This has a double advantage: the ORC machine being smaller, the amount of the investment can be reduced, and the ORC machine can maximize the operate time on an optimal point (maximum efficiency) thus generating maximum electricity for a faster return on investment.

According to the invention, the installation may further comprise another heat exchanger functionally arranged so as to transfer thermal energy from at least one other source to the organic fluid.

According to another aspect of the invention, there is provision for a beam reheating furnace equipped with burners, characterized in that it is equipped with an energy recovery installation according to the invention, said energy installation being connected to said furnace.

BRIEF DESCRIPTION OF THE DRAWINGS

Other features and advantages will become apparent in the light of the description of the preferred embodiments of the invention accompanied by the figures in which.

DETAILED DESCRIPTION OF THE PREFERRED EMBODIMENTS

These forms of embodiment being in no way exhaustive, it will be possible in particular to make variants of the invention comprising only a selection of the characteristics described hereinafter, as described or generalized, isolated from the other characteristics described, if this selection of characteristics is sufficient to confer a technical advantage or to differentiate the invention from the state of the art.

Figure 1:
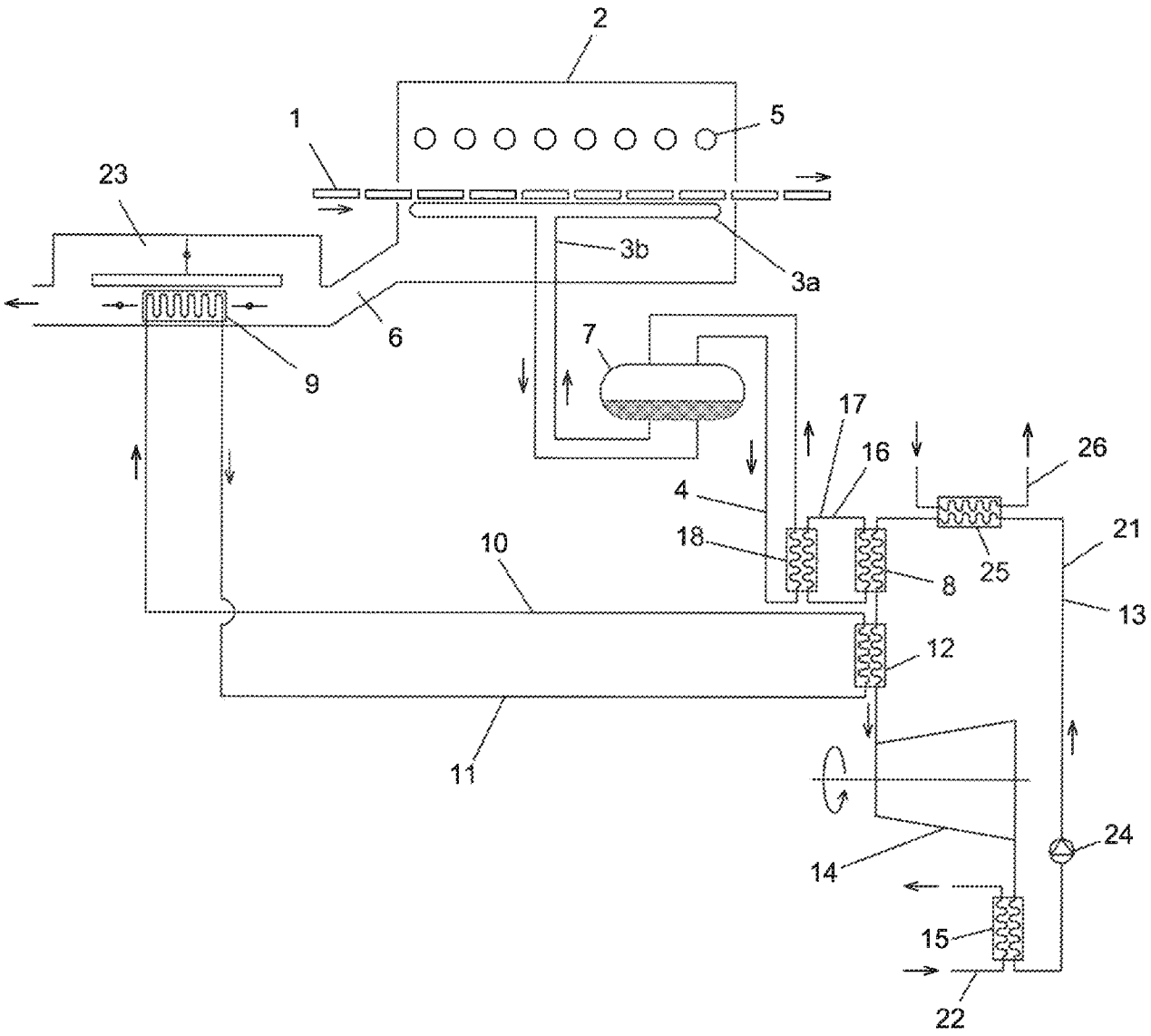
FIG. 1 diagrammatically represents an installation according to a first embodiment in which the organic fluid of the ORC machine is preheated in series by the energy recovery on the two sources, steam and flue gases.

In FIG. 1, we can see schematically represented an installation according to a first example of embodiment of the invention. To simplify the description, only the equipment necessary for understanding the invention is shown in this figure. Essential equipment for the operation of the installation, such as pumps, valves, food cover, expansion tank, etc., is not shown in this figure and following, nor contained in this description, the skilled person should know how to define them, size them and optimally implement them on the installation.

Products 1 are continuously heated in a beam reheating furnace 2. The movement and maintenance of the products in the furnace are provided by fixed beams and walking beams. The beams comprise skids 3*a* and posts 3*b* in which circulates a cooling fluid. Burners 5 heat the furnace 2 and the products 1. Flue gases from the burners 5 are discharged from the furnace by a flue pipe 6.

At the inlet of the beams, the cooling fluid is, for example, superheated water at a temperature of 215° C. and a pressure of 21 bar absolute. During its flow in the beams, the superheated water is partially converted into saturated steam 4. At the outlet of the beams, the cooling fluid is composed of a mixture of superheated water and saturated steam 4. A balloon 7 enables the separation of liquid water and saturated steam 4.

The installation comprises an ORC machine implementing a Rankine cycle on an organic fluid 21 circulating in a circuit 13.

The installation comprises an intermediate recirculation loop 16 disposed between the steam circuit and the circuit 13 of the ORC machine. An intermediate heat transfer fluid 17 circulates in the intermediate recirculation loop 16, preferably organic, kept in liquid state.

The intermediate recirculation loop 16 comprises in particular two heat exchangers 8 and 18 and a circulation pump, not shown. Thus, the saturated steam 4 gives calories to the intermediate coolant fluid 17 by means of the exchanger 18 in which it condenses, then the heat-transfer medium 17 in turn gives up calories to the organic fluid 21 of the ORC machine by means of the exchanger 8.

The addition of the intermediate recirculation loop 16 can enhance the safety of the installation and use thermal fluids of different properties. Thus, the intermediate heat transfer fluid 17 may have a greater compatibility with the vapour than the organic fluid 21 of the ORC thus limiting the risk of fire or explosion.

A heat exchanger 9 may be disposed in the chimney connector 6, possibly downstream, in the direction of the flue gas flow, with respect to other pieces of energy recovery equipment on the flue gases, for example a preheating recuperator of the combustion air of the burners.

The heat exchanger 9 can be supplied with a heat transfer fluid 10, preferably organic in liquid state, circulating in a recirculation loop 11. The heat transfer fluid 10 can be of the same nature as the intermediate heat transfer fluid 17, on the steam side but it can also be of a different nature. The flue gases transfer part of their heat to the heat transfer fluid 10 in the heat exchanger 9. A second heat exchanger 12 is disposed on the recirculation loop 11. The second exchanger 12 enables the transfer of calories captured by the heat transfer fluid 10 to the organic fluid 21 of the ORC machine.

The organic fluid circulates in the ORC machine in the recirculation loop 13 including, preferably successively in the direction of the fluid flow, the heat exchangers 8 and 12, an expansion turbine 14, an organic fluid 21 condensation exchanger 15 of the ORC machine and a booster pump 24. The heat energy transferred to the organic fluid 21 of the ORC machine in the heat exchangers 8 and 12 enables the latter to be brought into the vapour phase. The expansion of the steam rotates the expansion turbine 14 which is coupled to an alternator that generates electricity. At the outlet of the expansion turbine 14, the exchanger 15 makes it possible to condense the organic fluid 21, before it is returned to the heat exchangers 8 and 12 to undergo a new Rankine cycle. The organic fluid 21 transfers calories in the exchanger 15 to a heat transfer fluid flowing in a circuit 22.

A set of registers 23 makes it possible to bypass the heat exchanger 9, by all or part of the flue gases.

A heat exchanger 25 makes it possible to capture calories from a fluid 26 available on the site and to transmit them to the organic fluid 21 of the ORC machine. According to the invention, the installation thus makes it possible to also upgrade one or more other heat sources for increased overall efficiency of the industrial site on which it is installed.

Figure 2:
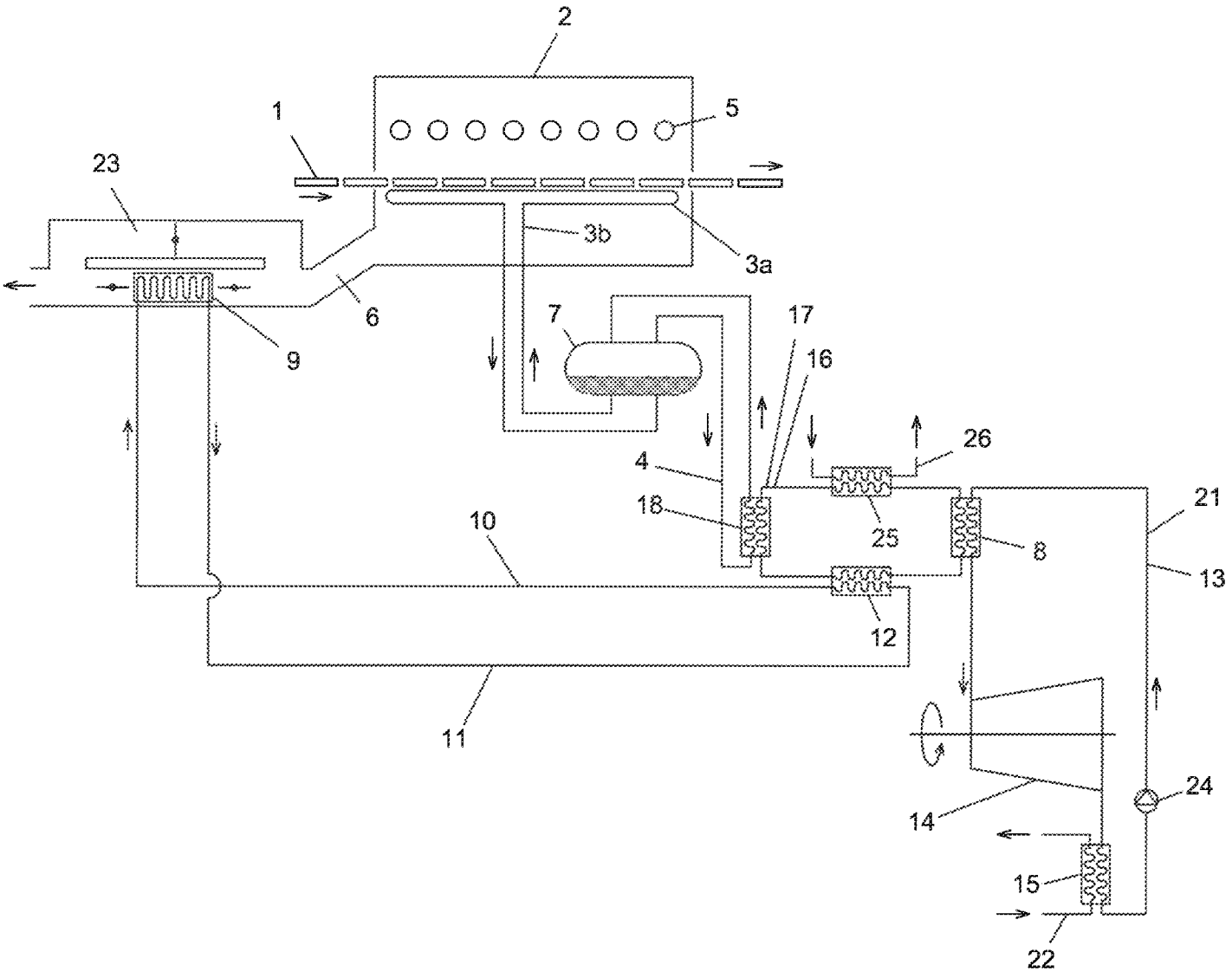
FIG. 2 diagrammatically represents an installation according to a second embodiment similar to that of FIG. 1, but in which the organic fluid of the ORC machine is preheated in a single step, after the upstream addition of the two steam and flue gas sources.

FIG. 2 schematically represents an alternative embodiment of the invention in which the flue gas calories are supplied to the intermediate fluid 17 and not directly to the fluid 21 of the ORC. Likewise, the complementary supply of calories of the fluid 26 is made to the intermediate fluid 17 and not directly to the fluid 21 of the ORC. This configuration allows a simplified control of the ORC, and increases its safety, with a single heat exchanger in which all the heat gains to the fluid 21 and its vaporization is achieved.

Figure 3:
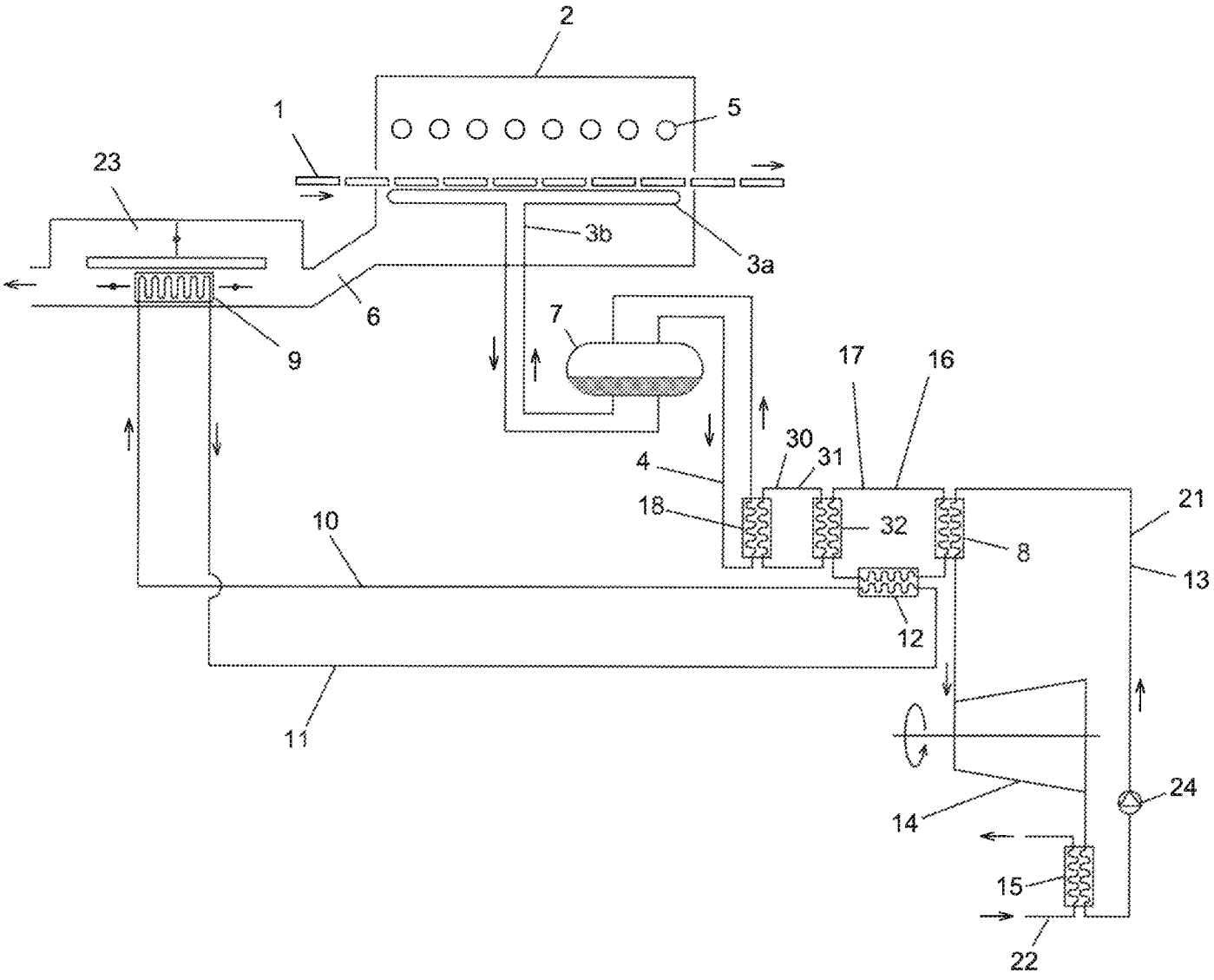
FIG. 3 diagrammatically represents an installation according to a third embodiment similar to that of FIG. 2 in which an additional intermediate circuit is added on the steam side.

FIG. 3 schematically represents another embodiment of the invention in which an intermediate loop 30 is added on the vapour side in which a heat transfer fluid 31 circulates. The steam 4 gives calories to the heat transfer fluid 31 by condensing in the exchanger 18, then the heat transfer fluid 31 in turn yields these calories to the heat transfer fluid 17 by means of a heat exchanger 32. This configuration makes it possible to reinforce the safety of the installation, and the flexibility of its control, the technology of the heat exchangers 8, 18, 31 and the nature of the heat transfer fluids 31, 17, 21 being chosen so as to have tested technologies on the heat exchangers and to limit the risk of fire or explosion in case of contact between the fluids in case the fluids exchangers get burst.

Figure 4:
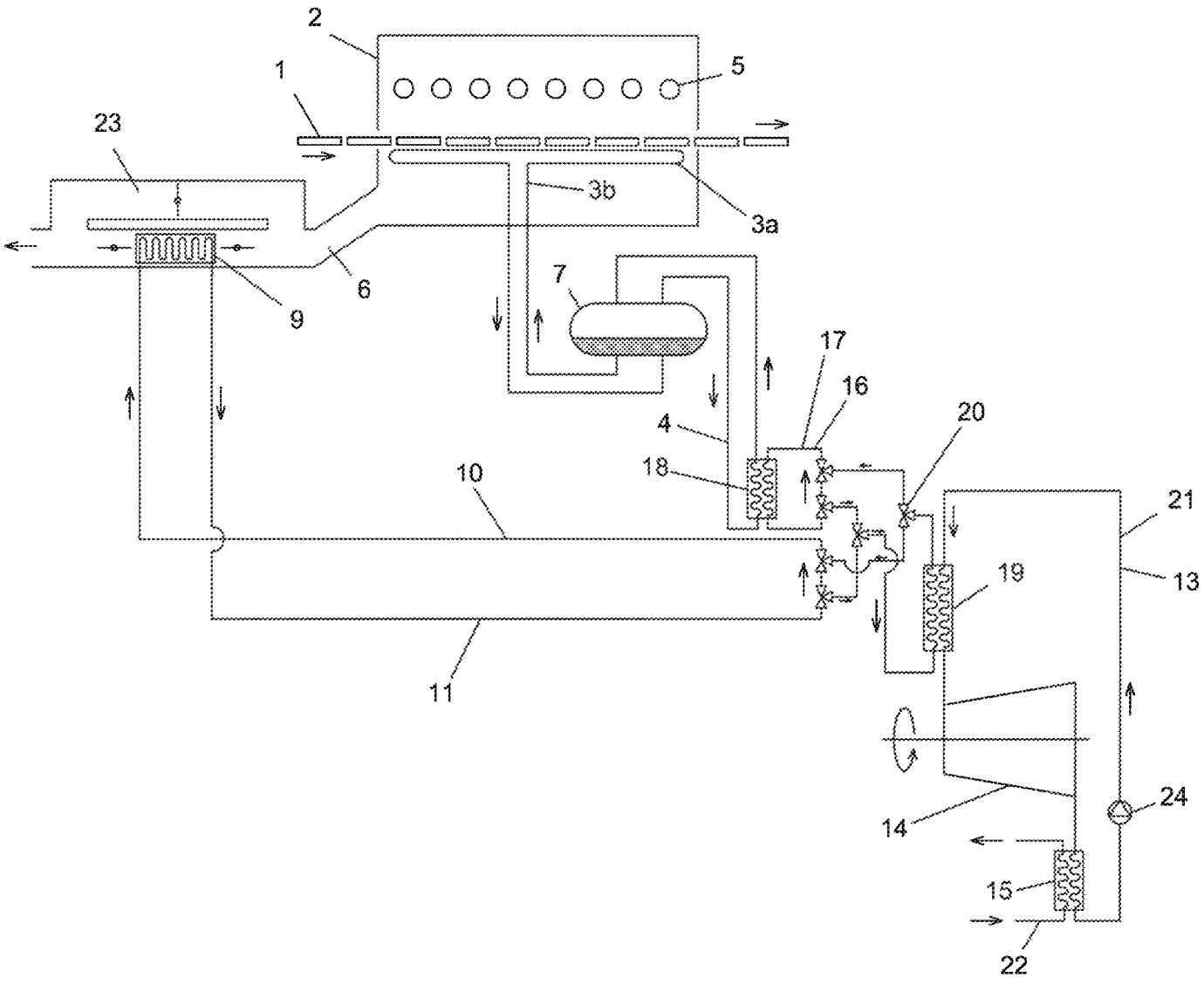
FIG. 4 schematically represents an installation according to a fourth embodiment in which organic fluids collecting the calories from the beams and combustion flue gases are mixed upstream of the ORC machine and the energy is recovered at the same time.

FIG. 4 diagrammatically represents another variant embodiment of the invention in which a mixture is produced between part of the heat transfer fluid 10 circulating in the recirculation loop 11 and a part of the intermediate heat-transfer fluid 17, preferably organic, circulating in the recirculation loop 16, the fluids 10 and 17 being of the same nature. This mixture, for example made by means of three-way valves 20, then flows to a heat exchanger 19 in which it transfers calories to the organic fluid 21 of the ORC machine. At the outlet of the exchanger 19, the fluid mixture is again distributed between the two recirculation loops 11 and 16, for example by means of three-way valves.

The amount of energy available on the flue gases and the beam coolants is generally around the same magnitude, for example 10 MWth on the flue gases and on the beams for a furnace with a capacity of 450 t/h.

On the heat exchanger 18, the temperature of the saturated vapour 4 being substantially constant, for example 215° C. for a pressure of 21 bars absolute, the heat exchange with the intermediate heat transfer fluid 17 of the recirculation loop 16 is always optimum.

On the heat exchanger 9, the flue gas temperature can vary, for example from 300° C., for a maximum capacity of the furnace, to 280° C. for 70% of its capacity. Thus, the heat exchange with the heat transfer fluid 10 of the recirculation loop 11 is variable and the operating conditions of the common fluid of the loop 20 entering the ORC machine can vary, in the case of a thermal oil, from a temperature of 225° C. to 215° C. and a flow rate of from 70 kg/s to 50 kg/s respectively according to the two cases of operation described above. For such temperatures, the organic fluid 21 of the most suitable ORC machine is pentane, since it is carried upstream of the expansion turbine 14 at a temperature for example of between 135° C. and 160° C., respectively, according to two cases of operation, so that the net power delivered by the ORC machine be maximum, of 1.2 $MW_e$ and 0.9 $MW_e$, respectively.

According to an exemplary embodiment of the invention, the energy recovery installation makes it possible to collect calories from at least two furnaces. A heat exchanger 9 may be disposed in the chimney connector of each furnace or of a single furnace. Likewise, calories can be recovered from steam coming from the beams of both furnaces or from one.

As we have just seen, the invention enables an efficient energy recovery on the heat losses of the furnace by the flue gases and the beams, thanks to a dimensioning of the ORC machine that is well adapted to the operating regime of the furnace and its operating stability resulting from the combination of two heat sources.

Of course, the invention is not limited to the examples which have just been described and many adjustments can be made to these examples without departing from the scope of the invention. In addition, the various features, shapes, variants and embodiments of the invention may be associated with each other in various combinations to the extent that they are not incompatible or exclusive of each other.

The invention claimed is:

1. A method for recovering energy by an energy recovery installation configured to be connected to at least one beam reheating furnace equipped with burners, said beam reheating furnace configured to cool beams, in which water flows, the water being in a liquid state at an inlet of the beams and in a mixture of a liquid/vapor state at an outlet of the beams, said installation including a turbine that generates electricity by from an organic fluid used in a Rankine cycle, said method comprising:

directly transferring thermal energy from the vapor to an intermediate heat transfer fluid by at least one first heat exchanger;

directly transferring thermal energy of said intermediate heat transfer fluid to the organic fluid by at least one second heat exchanger; and directly transferring thermal energy of at least a portion of flue gases from the burners via another heat transfer fluid and a fourth heat exchanger to one of: (i) the organic fluid via a third heat exchanger, (ii) the intermediate heat transfer fluid via a third heat exchanger, and (iii) the intermediate heat transfer fluid via a valve system wherein the at least one second heat exchanger, the third heat exchanger, and the fourth heat exchanger are separate from one another.

2. The method according to claim 1, wherein the other heat transfer fluid is an organic fluid in liquid state.

3. The method according to claim 1, wherein the other heat transfer fluid and the intermediate heat transfer fluid are of a same type, the intermediate heat transfer fluid and the other heat transfer fluid being mixed upstream of the at least one second heat exchanger in which the heat transfer between the intermediate and other heat transfer fluids and the organic fluid is carried out.

4. The method of claim 1, wherein the intermediate heat transfer fluid is organic and in a liquid state.

5. The method of claim 2, wherein the organic fluid is a thermal oil.

6. The method according to claim 2, wherein the other heat transfer fluid and the intermediate heat transfer fluid are of a same type, the intermediate heat transfer fluid and the other heat transfer fluid being mixed upstream of the at least one second heat exchanger in which the heat transfer between the intermediate and other heat transfer fluids and the organic fluid is carried out.

7. A heat energy recovery installation configured to be connected to at least one beam reheating furnace equipped with burners, said beam reheating furnace configured to cool beams, in which water flows, the water being in a liquid state at an inlet of the beams and in a mixture of a liquid/vapor state at an outlet of the beams, said heat energy recovery installation comprising:

a turbine configured to generate electricity from an organic fluid used in a Rankine cycle;

at least one first heat exchanger functionally configured to directly transfer thermal energy from the vapor to an intermediate heat transfer fluid;

at least one second heat exchanger configured to directly transfer heat energy from said intermediate heat transfer fluid to the organic fluid; and at least one third heat exchanger functionally configured to directly transfer at least a portion of calories contained in flue gases of the burners via another heat transfer fluid and a fourth heat exchanger to one of: (i) the organic fluid, and (ii) the intermediate heat transfer fluid and thereafter to the organic fluid, wherein the at least one second heat exchanger, the at least one third heat exchanger, and the fourth heat exchanger are separate from one another.

8. The installation according to claim 7, wherein the at least one beam reheating furnace comprises the fourth heat exchanger which is disposed in a flue gas discharge of said at least one beam reheating furnace to collect the calories from said flue gases and transmit the calories to the other heat transfer fluid flowing in said fourth heat exchanger.

9. The installation according to claim 7, wherein the other heat transfer fluid and the intermediate heat transfer fluid are of a same type.

10. The installation according to claim 7, further comprising a fifth heat exchanger functionally configured to directly or indirectly transfer heat energy from at least one other source to the organic fluid.

11. The installation of claim 7, wherein the intermediate heat transfer fluid is organic and in a liquid state.

12. The installation according to claim 8, wherein the other heat transfer fluid and the intermediate heat transfer fluid are of a same type.

13. The installation according to claim 8, further comprising a fifth heat exchanger functionally configured to directly or indirectly transfer heat energy from at least one other source to the organic fluid.

14. The installation according to claim 9, further comprising a fifth heat exchanger functionally configured to directly or indirectly transfer heat energy from at least one other source to the organic fluid.

15. The installation according to claim 12, further comprising a fifth heat exchanger functionally configured to directly or indirectly transfer heat energy from at least one other source to the organic fluid.

* * * * *